US007064725B2

(12) United States Patent
Shtrikman et al.

(10) Patent No.: US 7,064,725 B2
(45) Date of Patent: Jun. 20, 2006

(54) CONICAL BEAM CROSS-SLOT ANTENNA

(75) Inventors: Ilan Shtrikman, Tiberias (IL); Najeed Azzam, Nazareth (IL)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 11/064,443

(22) Filed: Feb. 23, 2005

(65) Prior Publication Data

US 2005/0200543 A1 Sep. 15, 2005

Related U.S. Application Data

(60) Provisional application No. 60/547,409, filed on Feb. 23, 2004.

(51) Int. Cl.
*H01Q 13/10* (2006.01)

(52) U.S. Cl. ..... 343/770; 343/767; 343/764

(58) Field of Classification Search ..... 343/770, 343/767

See application file for complete search history.

(56) References Cited

U.S. PATENT DOCUMENTS 4,916,457 A * 4/1990 Foy et al. ..... 343/770
4,958,165 A * 9/1990 Axford et al. ..... 343/770
6,052,093 A * 4/2000 Yao et al. ..... 343/770
6,466,176 B1 * 10/2002 Maoz et al. ..... 343/767
6,489,924 B1 * 12/2002 Pretorius et al. ..... 343/700 MS
6,492,949 B1 12/2002 Breglia et al. ..... 343/700 MS
6,507,320 B1 * 1/2003 Von Stein et al. ..... 343/770
6,507,321 B1 * 1/2003 Oberschmidt et al. ..... 343/770
6,522,303 B1 * 2/2003 West et al. ..... 343/770
6,861,996 B1 * 3/2005 Jeong ..... 343/770
2002/0175874 A1 * 11/2002 Eason ..... 343/770
2004/0004576 A1 * 1/2004 Anderson ..... 343/770
2004/0104859 A1 * 6/2004 Lo ..... 343/767
2005/0113946 A9 * 5/2005 Janik ..... 700/94

OTHER PUBLICATIONS

Jun-iehi Takada et al., "A Radial Line Slot Antenna Radiating Circularly Polarized Conical Beam", 1994.
Michael A. Forman, et al., "A Tunable Second-Resonance Cross-Slot Antenna", 1997.

* cited by examiner

*Primary Examiner*—Trinh Dinh
*Assistant Examiner*—Binh Van Ho
(74) *Attorney, Agent, or Firm*—Ladas & Parry LLP

(57) ABSTRACT

An antenna assembly including a ground plane and a generally planar cross-slot antenna, spaced from the ground plane and arranged generally parallel thereto, the generally planar cross-slot antenna including a generally rigid dielectric substrate having formed on a first side thereof, a metal layer which defines mutually spaced rectangular slots at which the metal layer is not present and having formed on a second side thereof, there are defined feed lines extending radially outwardly from a central junction thereof, each to cross a corresponding one of the rectangular slots.

19 Claims, 8 Drawing Sheets

CONICAL BEAM CROSS-SLOT ANTENNA

REFERENCE TO COPENDING APPLICATIONS

Reference is made to copending U.S. Provisional Patent Application 60/547,409, filed Feb. 23, 2004 and entitled Conical Beam Cross-Slot Antenna, the contents of which are hereby incorporated by reference and priority of which is hereby claimed pursuant to 37 CFR 1.78(a) (4) and (5)(i).

FIELD OF THE INVENTION

The present invention relates to antennas generally and more particularly to directional antennas.

BACKGROUND OF THE INVENTION

The following U.S. Patent Publications are believed to represent the current state of the art: 6,489,924; 6,492,949; 6,507,320 and 6,507,321.

SUMMARY OF THE INVENTION

The present invention seeks to provide an improved directional antenna. Such an antenna is believed to be particularly useful, inter alia, for ceiling mounting as part of a wireless LAN system.

There is thus provided in accordance with a preferred embodiment of the present invention an antenna assembly including a ground plane and a generally planar cross-slot antenna, spaced from the ground plane and arranged generally parallel thereto, the generally planar cross-slot antenna including a generally rigid dielectric substrate having formed on a first side thereof, a metal layer which defines mutually spaced rectangular slots at which the metal layer is not present and having formed on a second side thereof, there are defined feed lines extending radially outwardly from a central junction thereof, each to cross a corresponding one of the rectangular slots.

In accordance with a preferred embodiment of the present invention the feed lines extend in a circuitous route from the junction to respective ones of the rectangular slots. Alternatively, the feed lines extend first radially and then at an acute angle to respective ones of the rectangular slots.

In accordance with another preferred embodiment of the present invention the antenna assembly also includes a wireless LAN transceiver connected to the ground plane and to the antenna. Preferably, the antenna assembly also includes a LAN server connected to the ground plane and to the antenna via the LAN transceiver.

In accordance with yet another preferred embodiment of the present invention the generally planar cross-slot antenna is spaced from the ground plane by a dielectric spacer. Alternatively, the generally planar cross-slot antenna is spaced from the ground plane by air.

In accordance with a further preferred embodiment of the present invention the first side of the generally rigid dielectric substrate is arranged to face the ground plane and the second side of the generally rigid dielectric substrate is arranged to face away from the ground plane. Preferably, each one of the mutually spaced rectangular slots is spaced by 90 degrees from adjacent ones of the mutually spaced rectangular slots.

In accordance with yet a further preferred embodiment of the present invention the antenna assembly also includes a coaxial signal feed connector having an outer conductor and an inner conductor. Preferably, the outer conductor is soldered to the ground plane and the inner conductor extends through the ground plane such that it is electrically insulated therefrom and is soldered to the central junction.

In accordance with a still further preferred embodiment of the present invention the antenna assembly also includes an additional coaxial signal feed connector having an outer conductor and an inner conductor. Preferably, the outer conductor of additional coaxial signal feed connector is soldered to the ground plane and the inner conductor of additional coaxial signal feed connector extends through the ground plane such that it is electrically insulated therefrom and extends generally perpendicular outward of the generally planar cross-slot antenna.

In accordance with another preferred embodiment of the present invention the additional coaxial signal feed connector includes a monopole antenna. Preferably, the antenna is a polarization diversity antenna.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
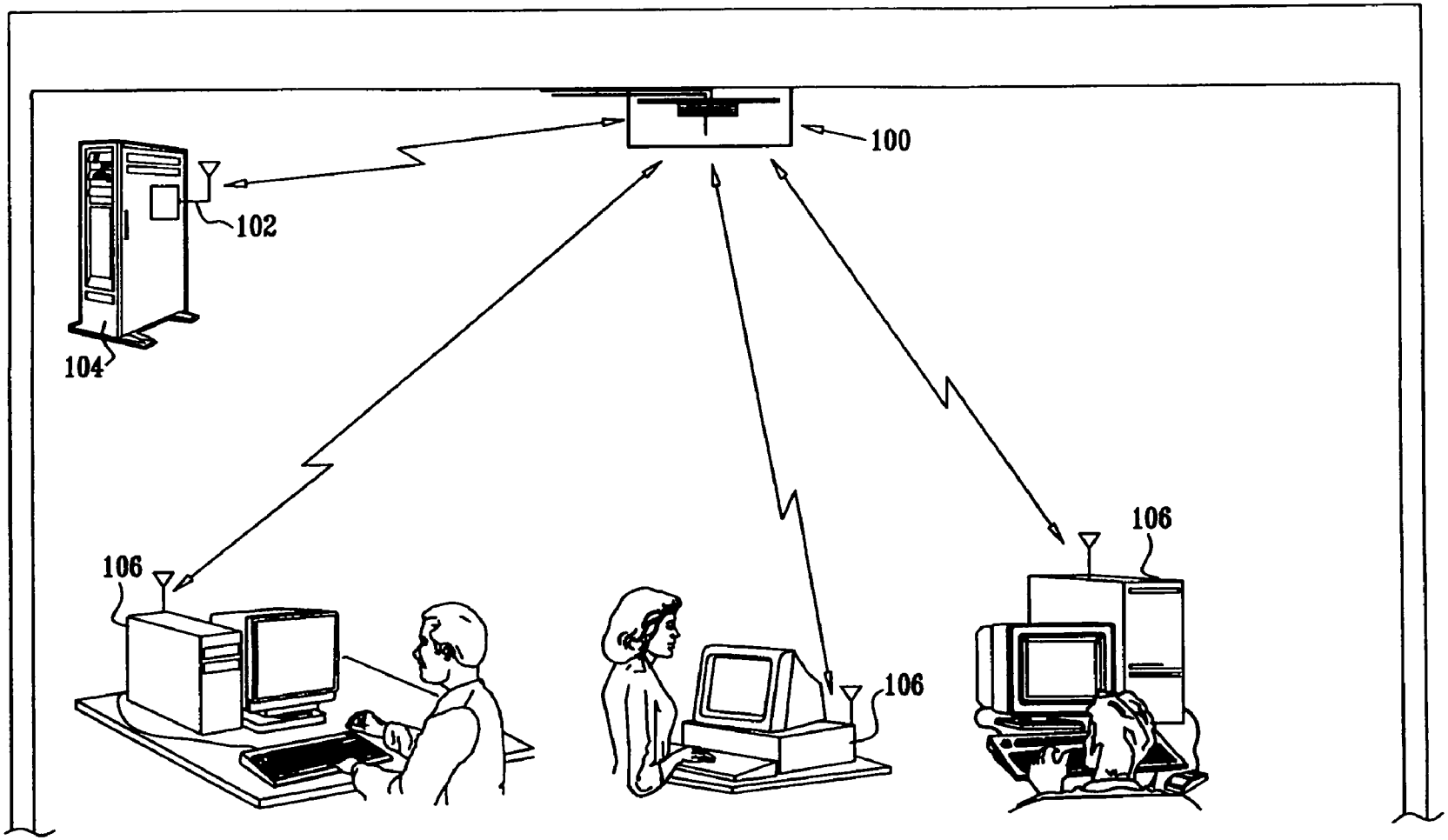
FIG. 1 is a simplified pictorial illustration of a wireless LAN system employing an antenna assembly constructed and operative in accordance with a preferred embodiment of the present invention.

Reference is now made to FIG. 1, which is a simplified pictorial illustration of a wireless LAN system employing an antenna assembly constructed and operative in accordance with a preferred embodiment of the present invention. As seen in FIG. 1, a wireless LAN includes an antenna assembly 100, constructed and operative in accordance with a preferred embodiment of the present invention, which is coupled via a conventional wireless LAN transceiver 102 to a LAN server 104. A plurality of user computers 106 communicate wirelessly with the LAN server 104 via the antenna assembly 100 and transceiver 102. Alternatively, wireless LAN transceiver 102 and LAN server 104 may be replaced by any other suitable application where conical coverage in horizontal polarization is appropriate.

Figure 2A:
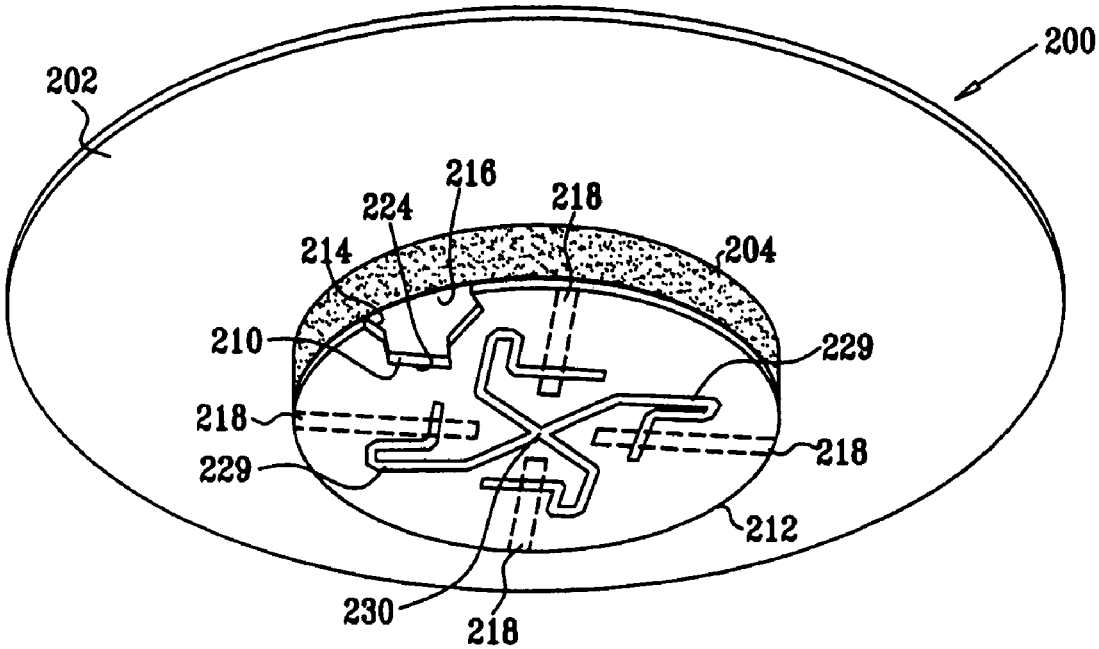
FIGS. 2A and 2B are simplified pictorial illustrations of first and second sides of one embodiment of the antenna assembly employed in the wireless LAN system of FIG. 1.
Figure 2B:
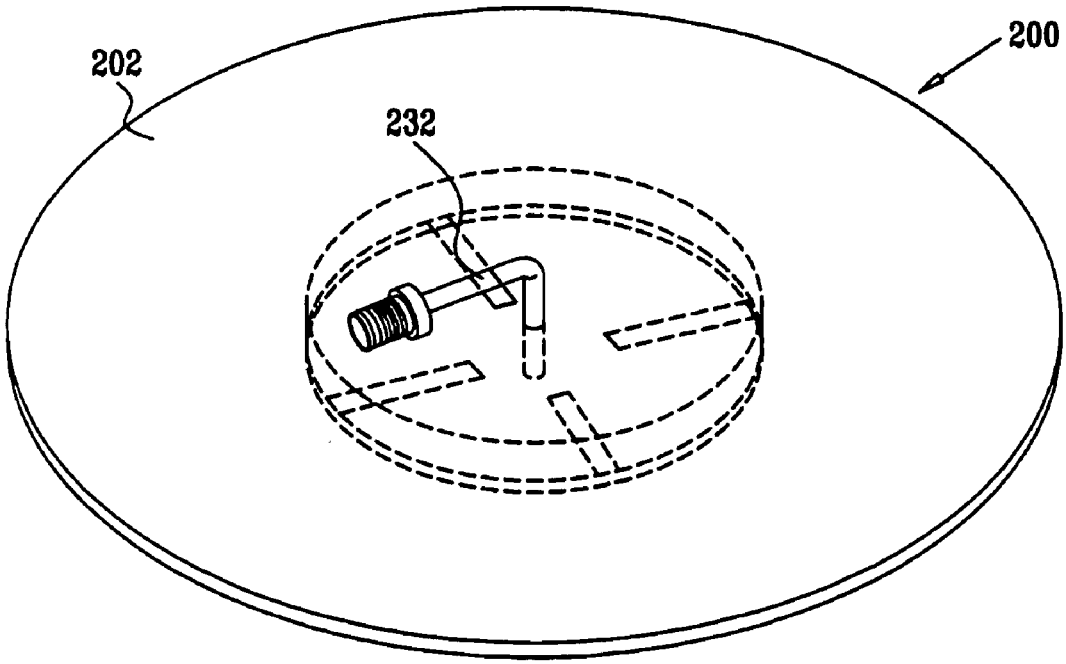
Figure 3:
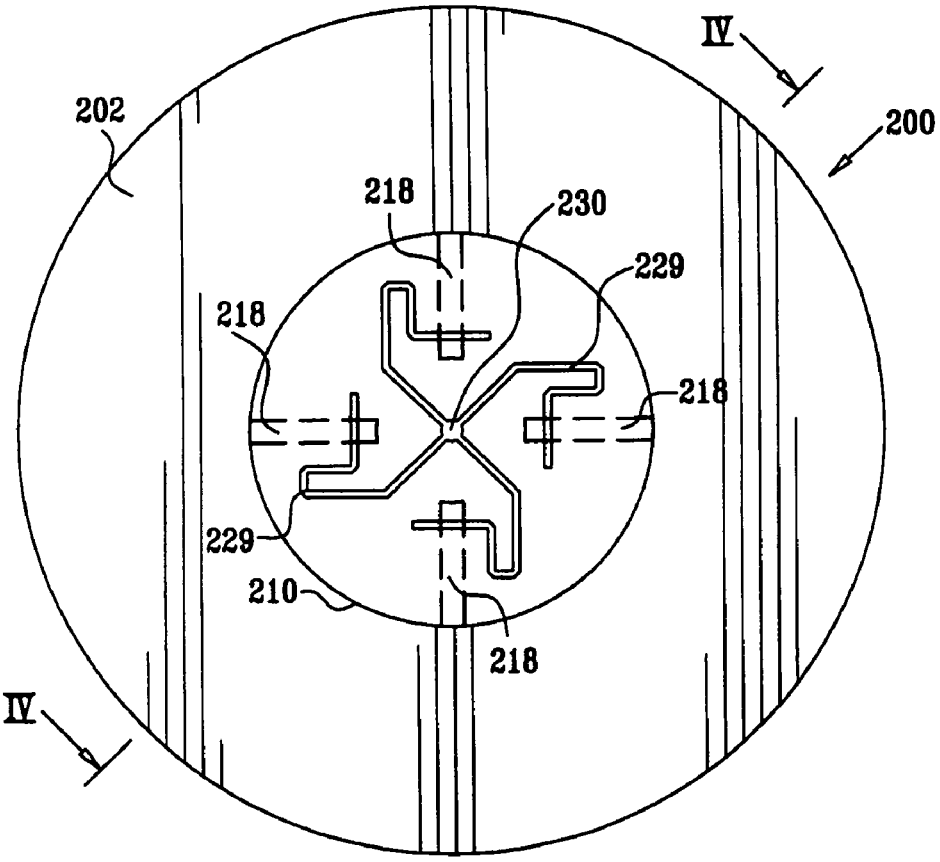
FIG. 3 is a simplified planar view illustration of the antenna assembly of FIGS. 2A and 2B.
Figure 4:
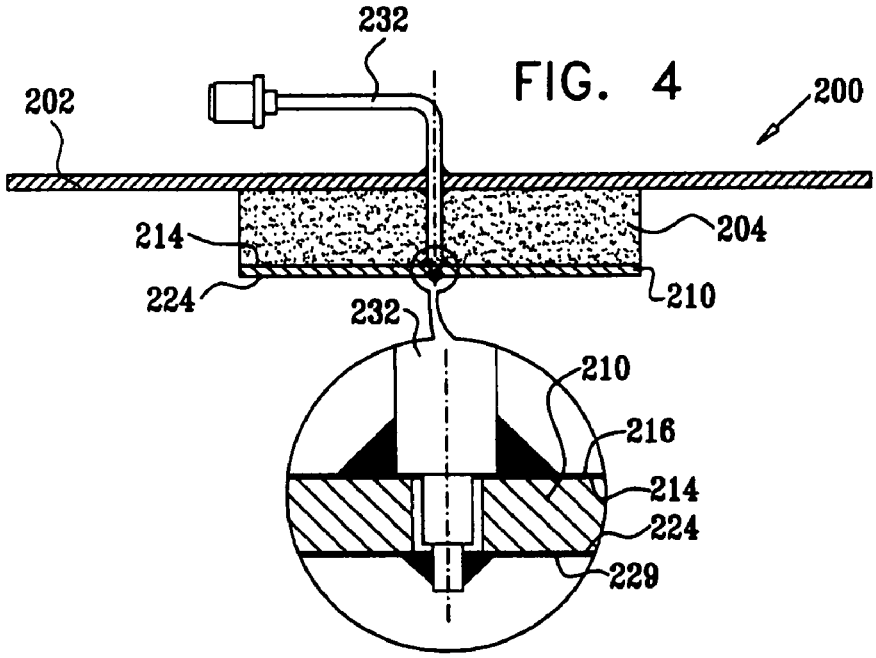
FIG. 4 is a sectional illustration taken along lines IV—IV in FIG. 3.

Reference is now made to FIGS. 2A and 2B, which are simplified pictorial illustrations of first and second sides of one embodiment of the antenna assembly employed in the wireless LAN system of FIG. 1 and to FIG. 3, a simplified planar view illustration of the antenna assembly of FIGS. 2A and 2B and FIG. 4, a sectional illustration taken along lines IV—IV in FIG. 3.

As seen in FIGS. 2A–4, an antenna assembly 200 includes a ground plane 202, typically formed of solid metal, such as copper. Spaced from ground plane 202, typically by a dielectric spacer 204 or alternatively by air, and arranged generally parallel to ground plane 202, is a generally planar cross-slot antenna 210, preferably including a generally rigid dielectric substrate 212, such as that used for PCBs.

On a first side of the substrate, designated by reference numeral 214, and arranged to face the ground plane 202, there is formed a metal layer 216 which is generally uniform and covers the substrate 214 except for four mutually spaced rectangular slots 218 at which the metal layer 216 is not present. Each of slots 218 extends radially inwardly from a periphery of the substrate 214. Each slot 218 is perpendicular and spaced by 90 degrees from the slots 218 on both sides thereof. It is appreciated that a different number of mutually spaced rectangular slots 218 may also be employed.

On a second side of the substrate, designated by reference numeral 224, and arranged to face away from the ground plane 202, there are defined four metal feed lines 229 extending radially outwardly from a central junction 230 and then in a somewhat circuitous manner, each to cross a corresponding slot 218 at a location near to its radially inward end.

A coaxial signal feed connector is preferably provided, having an outer conductor 232 soldered to the ground plane 202 and an inner conductor extending through the ground plane 202, electrically insulated therefrom, and being soldered to junction 230 of the feed lines 229.

Figure 11:
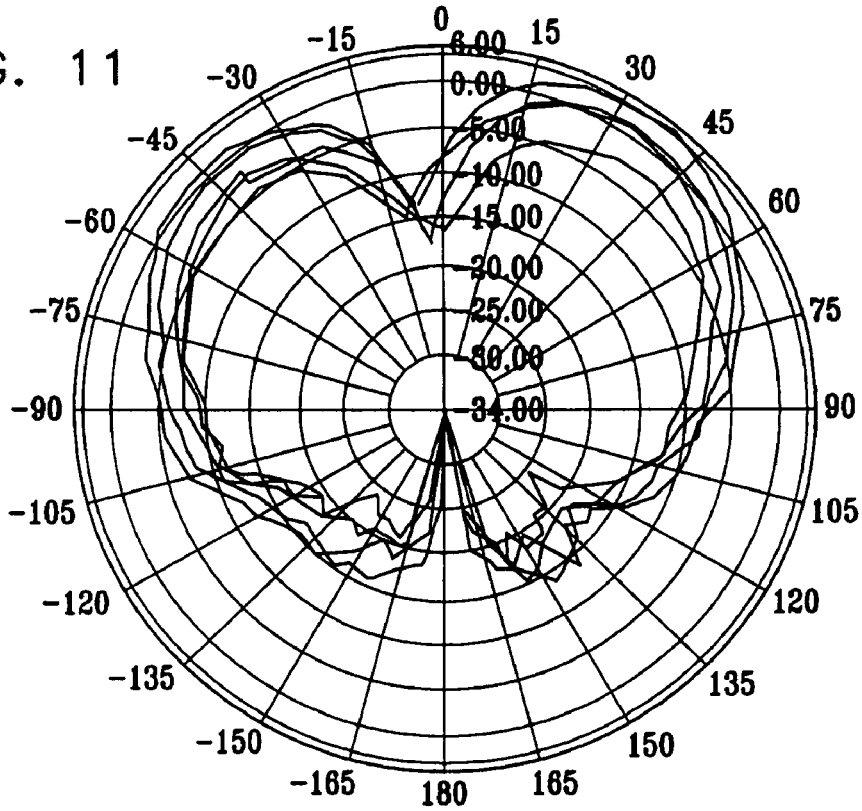
FIG. 11 is a diagram of a characteristic radiation pattern of a cross-slot antenna constructed and operative in accordance with the present invention.

The cross-slot antenna of the embodiment of FIGS. 2A–4 preferably has a characteristic radiation pattern shown in FIG. 11.

Figure 5A:
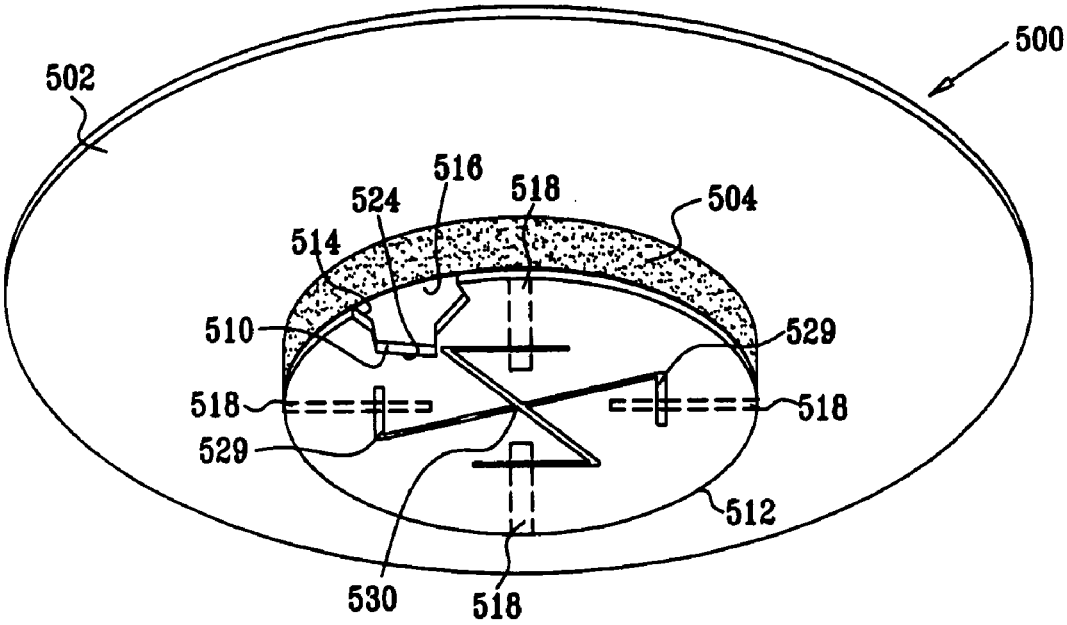
FIGS. 5A and 5B are simplified pictorial illustrations of first and second sides of another embodiment of the antenna assembly employed in the wireless LAN system of FIG. 1.
Figure 5B:
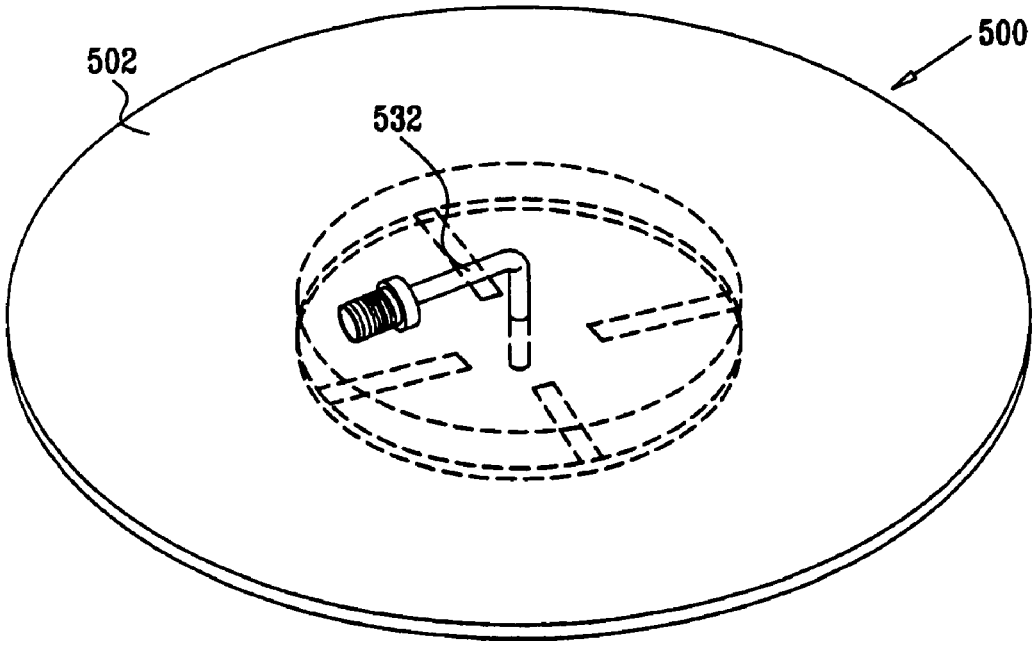
Figure 6:
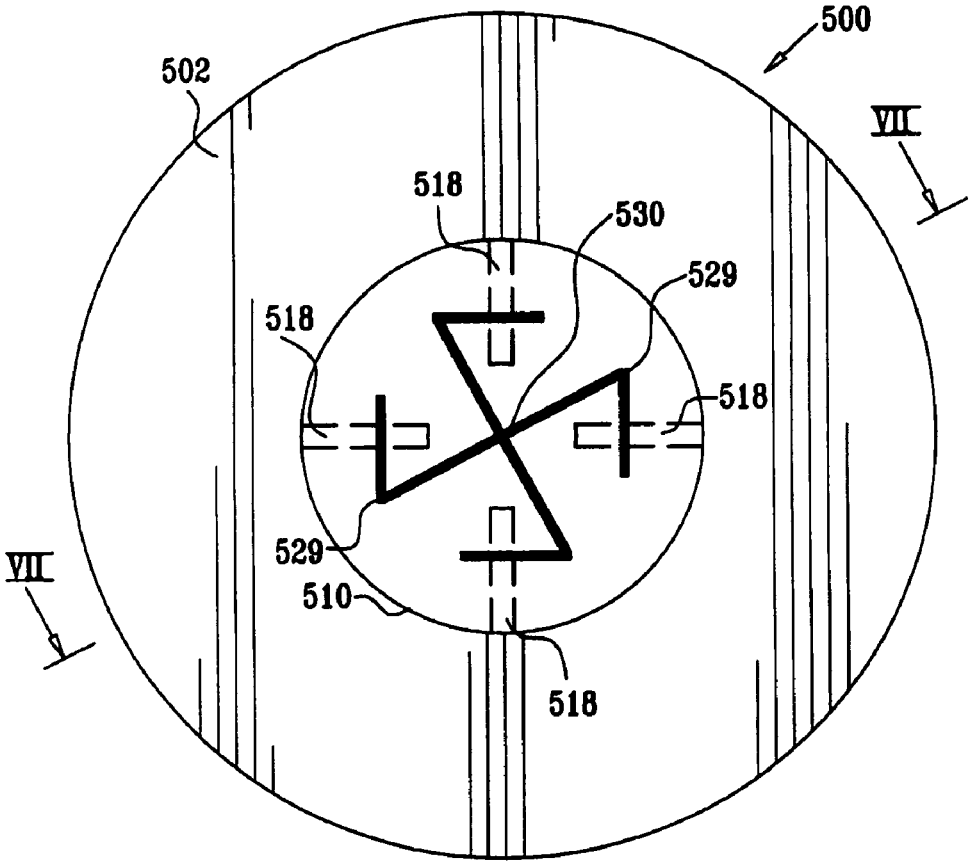
FIG. 6 is a simplified planar view illustration of the antenna assembly of FIGS. 5A and 5B.
Figure 7:
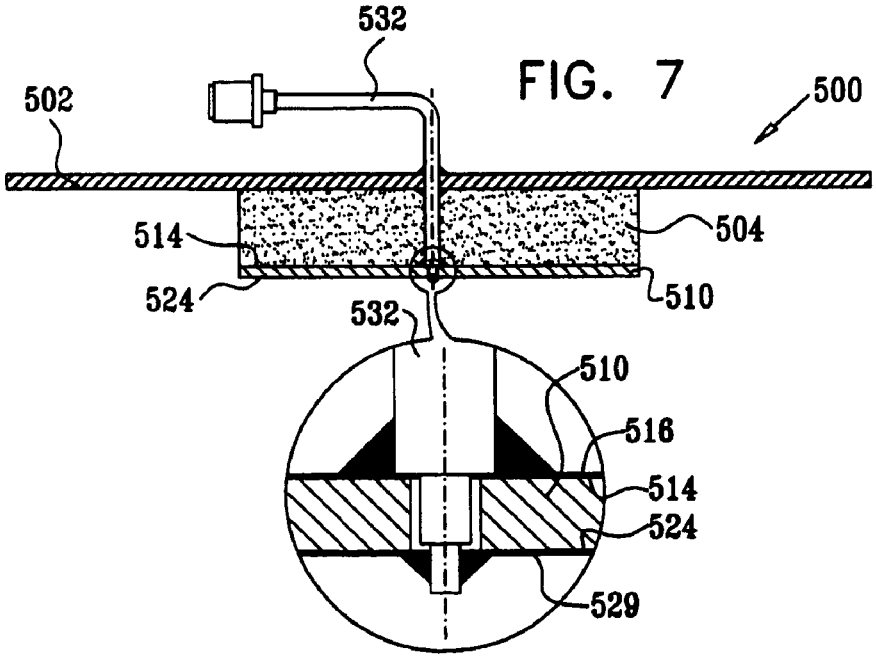
FIG. 7 is a sectional illustration taken along lines VII—VII in FIG. 6.

Reference is now made to FIGS. 5A and 5B, which are simplified pictorial illustrations of first and second sides of another embodiment of the antenna assembly employed in the wireless LAN system of FIG. 1 and to FIG. 6, a simplified planar view illustration of the antenna assembly of FIGS. 5A and 5B and FIG. 7, a sectional illustration taken along lines VII—VII in FIG. 6.

As seen in FIGS. 5A–7, an antenna assembly 500 includes a ground plane 502, typically formed of solid metal, such as copper. Spaced from ground plane 502, typically by a dielectric spacer 504 or alternatively by air, and arranged generally parallel to ground plane 502, is a generally planar cross-slot antenna 510, preferably including a generally rigid dielectric substrate 512, such as that used for PCBs.

On a first side of the substrate, designated by reference numeral 514, and arranged to face the ground plane 502, there is formed a metal layer 516 which is generally uniform and covers the substrate 514 except for four mutually spaced rectangular slots 518 at which the metal layer 516 is not present. Each of slots 518 extends radially inwardly from a periphery of the substrate 514. Each slot 518 is perpendicular and spaced by 90 degrees from the slots 518 on both sides thereof. It is appreciated that a different number of mutually spaced rectangular slots 518 may also be employed.

On a second side of the substrate, designated by reference numeral 524, and arranged to face away from the ground plane 502, there are defined four metal feed lines 529 extending radially outwardly from a central junction 530 and then proceeding at an acute angle to cross a corresponding slot 518 at a location near to its radially inward end.

A coaxial signal feed connector is preferably provided, having an outer conductor 532 soldered to the ground plane 502 and an inner conductor extending through the ground plane 502, electrically insulated therefrom, and being soldered to junction 530 of the feed lines 529.

The cross-slot antenna of the embodiment of FIGS. 5A–7 preferably has a characteristic radiation pattern shown in FIG. 11.

Figure 8A:
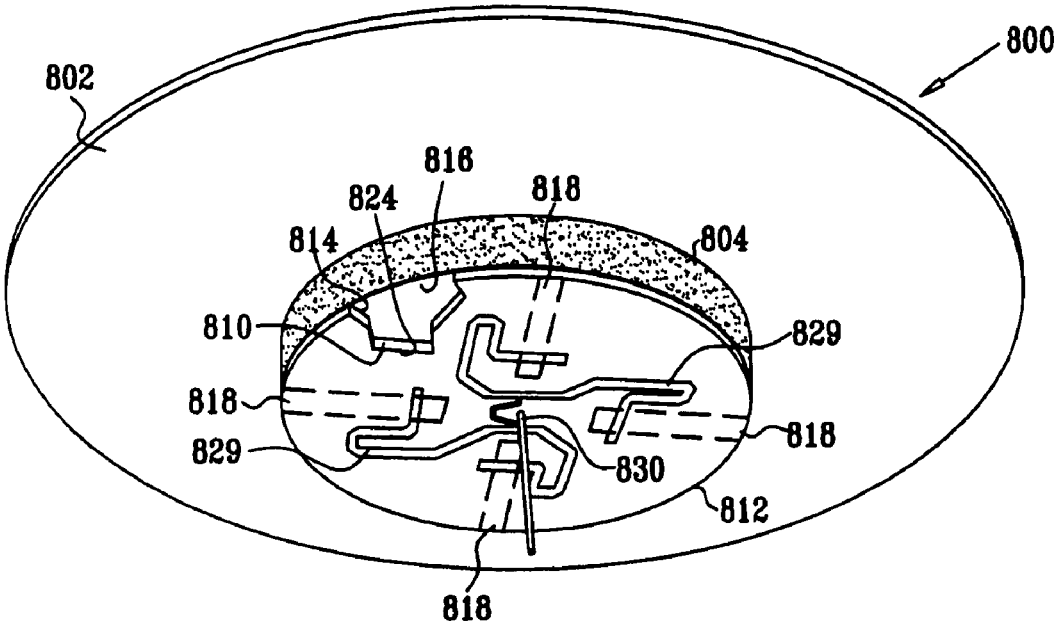
FIGS. 8A and 8B are simplified pictorial illustrations of first and second sides of still another embodiment of the antenna assembly employed in the wireless LAN system of FIG. 1.
Figure 8B:
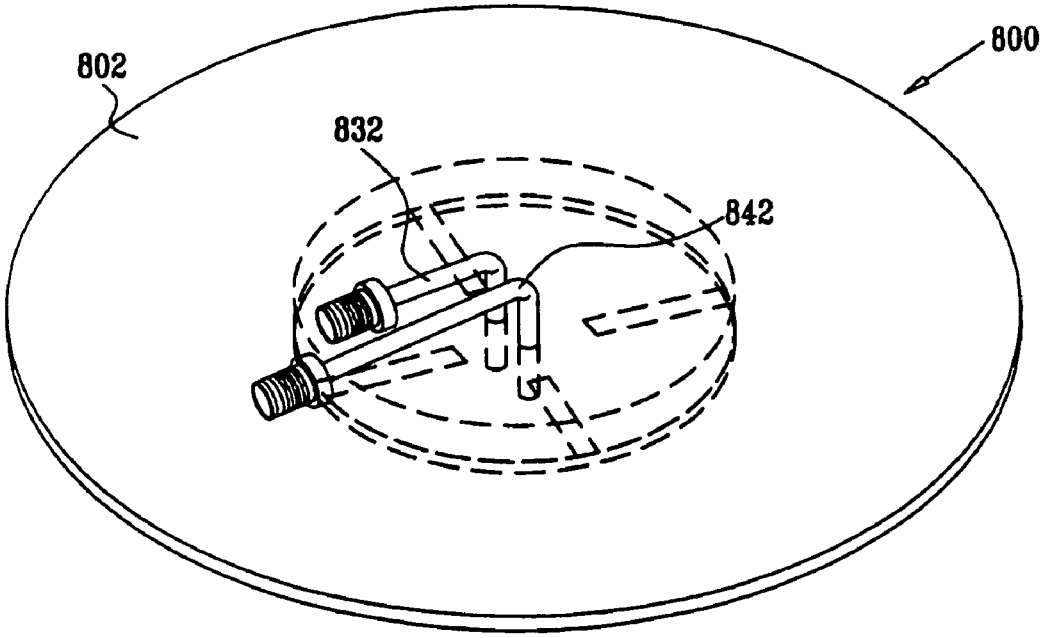
Figure 9:
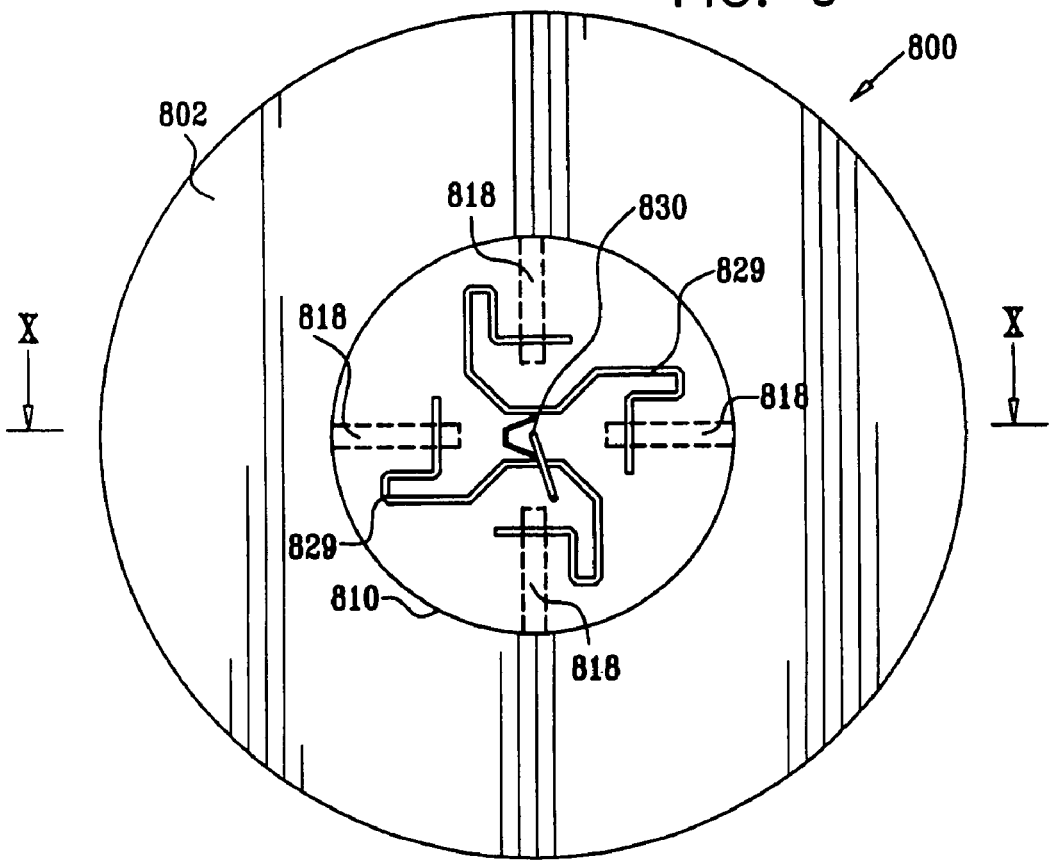
FIG. 9 is a simplified planar view illustration of the antenna assembly of FIGS. 8A and 8B.
Figure 10:
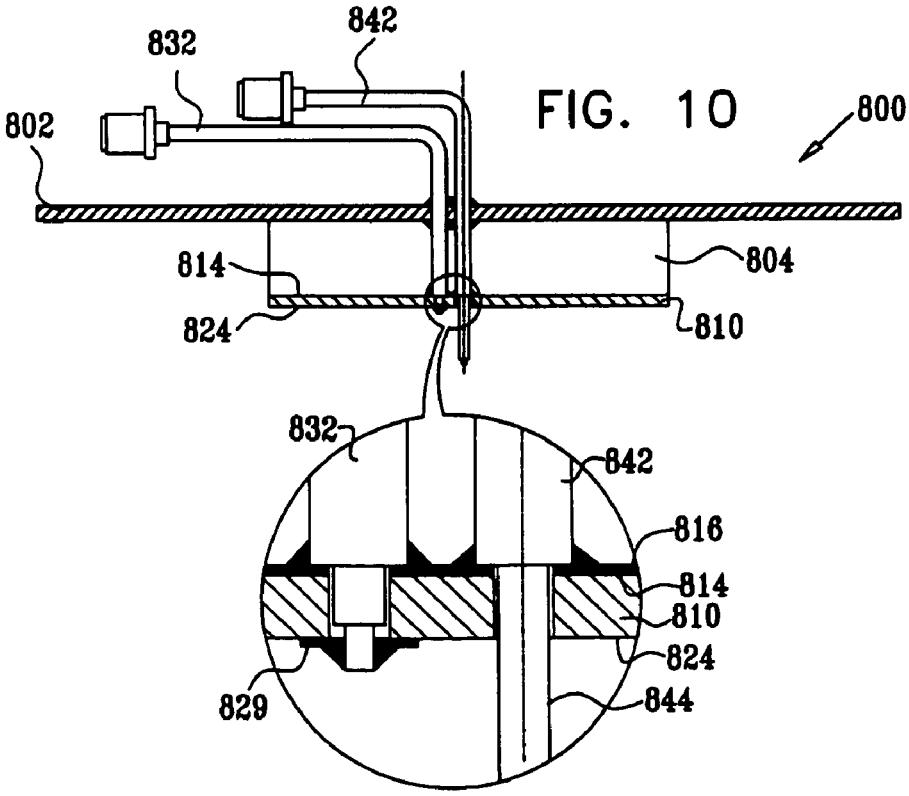
FIG. 10 is a sectional illustration taken along lines X—X in FIG. 9.

Reference is now made to FIGS. 8A and 8B, which are simplified pictorial illustrations of first and second sides of yet another embodiment of the antenna assembly employed in the wireless LAN system of FIG. 1 and to FIG. 9, a simplified planar view illustration of the antenna assembly of FIGS. 8A and 8B and FIG. 10, a sectional illustration taken along lines X—X in FIG. 9.

As seen in FIGS. 8A–10, an antenna assembly 800 includes a ground plane 802, typically formed of solid metal, such as copper. Spaced from ground plane 802, typically by a dielectric spacer 804 or alternatively by air, and arranged generally parallel to ground plane 802, is a generally planar cross-slot antenna 810, preferably including a generally rigid dielectric substrate 812, such as that used for PCBs.

On a first side of the substrate, designated by reference numeral 814, and arranged to face the ground plane 802, there is formed a metal layer 816 which is generally uniform and covers the substrate 814 except for four mutually spaced rectangular slots 818 at which the metal layer 816 is not present. Each of slots 818 extends radially inwardly from a periphery of the substrate 814. Each slot 818 is perpendicular and spaced by 90 degrees from the slots 818 on both sides thereof. It is appreciated that a different number of mutually spaced rectangular slots 818 may also be employed.

On a second side of the substrate, designated by reference numeral 824, and arranged to face away from ground plane 802, there are defined four metal feed lines 829 extending radially outwardly from a central junction 830 and then proceeding somewhat circuitously to cross a corresponding slot 818 at a location near to its radially inward end.

A coaxial signal feed connector is preferably provided, having an outer conductor 832 soldered to the ground plane 802 and an inner conductor extending through the ground plane 802, electrically insulated therefrom, and being soldered to junction 830 of the feed lines 829.

An additional coaxial signal feed connector is preferably provided, having an outer conductor 842 soldered to the ground plane 802 and an inner conductor extending through the ground plane 802, electrically insulated therefrom, and extending generally perpendicularly outward of generally planar cross-slot antenna 810 and defining a monopole antenna 844. The length of the monopole antenna 844 is preferably a quarter of the wavelength at the operative frequency.

It is appreciated that the profile of the monopole antenna 844 may be lowered by shortening the monopole and top-loading it with a circular disk and subsequently matching it with Gamma-match, as is well known in the art.

It is also appreciated that antenna described hereinabove with reference to FIGS. 8A–10 may generally be applied as a polarization diversity antenna, thus improving signal reception in a fading environment.

It is appreciated that in any of the embodiments of FIGS. 1–10 the number of slots formed in the antenna assembly is not limited to four, and any suitable number of slots equal to or larger than three may be formed in the substrate of the antenna.

Figure 12:
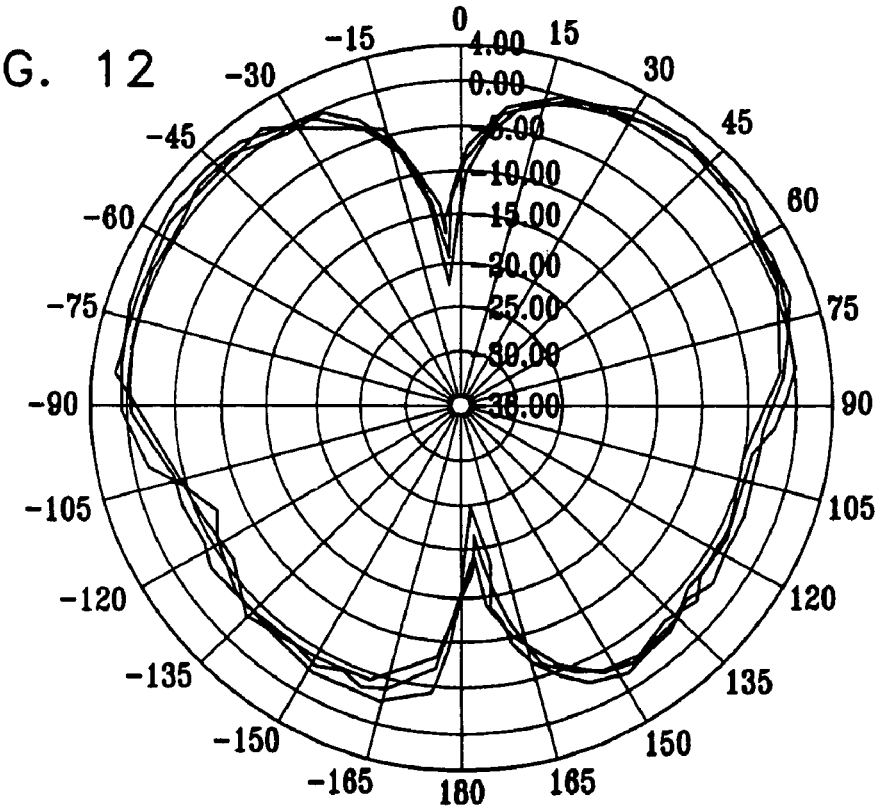
FIG. 12 is a diagram of a characteristic radiation pattern of a monopole antenna constructed and operative in accordance with the present invention.

The cross-slot antenna of the embodiment of FIGS. 8A–10 preferably has a characteristic radiation pattern shown in FIG. 11, and the monopole antenna of the embodiment of FIGS. 8A–10 preferably has a characteristic radiation pattern shown in FIG. 12.

Reference is now made to FIG. 11, which is a diagram of a characteristic radiation pattern of a cross-slot antenna constructed and operative in accordance with the present invention and to FIG. 12, which is a diagram of a characteristic radiation pattern of a monopole antenna constructed and operative in accordance with the present invention.

As seen in FIGS. 11 and 12, the characteristic radiation of both antennas is conical, such that in the center of the cone the radiation is weaker than at the edges of the cone. Additionally, each of the described antennas has some radiation which is emitted rearwardly, and in the case of the present invention it is emitted toward the ground plane. However, the polarization of the far field of the cross slot antenna is horizontal, whereas the polarization of the far field of the monopole antenna is vertical.

It will be appreciated by persons skilled in the art that the present invention is not limited to what has been particularly shown and described hereinabove. Rather the present invention includes both combinations and subcombinations of the features described hereinabove as well as modifications and variations which would occur to persons skilled in the art upon reading the foregoing description and which are not in the prior art.

The invention claimed is:

1. An antenna assembly comprising:

a ground plane; and a generally planar cross-slot antenna, spaced from said ground plane and arranged generally parallel thereto, said generally planar cross-slot antenna including a generally rigid dielectric substrate having formed on a first side thereof, a metal layer which defines mutually spaced rectangular slots at which said metal layer is not presents and having formed on a second side thereof, feed lines extending radially outwardly from a central junction thereof, each crossing a corresponding one of said rectangular slots.

2. An antenna assembly according to claim 1 and wherein said feed lines extend in a circuitous route from said junction to respective ones of said rectangular slots.

3. An antenna assembly according to claim 1 and wherein said feed lines extend first radially and then at an acute angle to respective ones of said rectangular slots.

4. An antenna assembly according to claim 1 and also comprising a wireless LAN transceiver connected to said ground plane and to said cross-slot antenna.

5. An antenna assembly according to claim 4 and also comprising a LAN server connected to said ground plane and to said cross-slot antenna via said LAN transceiver.

6. An antenna assembly according to claim 1 and wherein said generally planar cross-slot antenna is spaced from said ground plane by a dielectric spacer.

7. An antenna assembly according to claim 1 and wherein said generally planar cross-slot antenna is spaced from said ground plane by air.

8. An antenna assembly according to claim 1 and wherein said first side of said generally rigid dielectric substrate is arranged to face said ground plane and said second side of said generally rigid dielectric substrate is arranged to face away from said ground plane.

9. An antenna assembly according to claim 1 and wherein each one of said mutually spaced rectangular slots is spaced by 90 degrees from adjacent ones of said mutually spaced rectangular slots.

10. An antenna assembly according to claim 1 and wherein said antenna assembly also comprises a coaxial signal feed connector having an outer conductor and an inner conductor.

11. An antenna assembly according to claim 10 and wherein said outer conductor is soldered to said ground plane and said inner conductor extends through said ground plane such that it is electrically insulated therefrom and is soldered to said central junction.

12. An antenna assembly according to claim 1 and wherein said antenna assembly also comprises an additional coaxial signal feed connector having an outer conductor and an inner conductor.

13. An antenna assembly according to claim 12 and wherein said outer conductor of additional coaxial signal feed connector is soldered to said ground plane and said inner conductor of additional coaxial signal feed connector extends through said ground plane such that it is electrically insulated therefrom and extends generally perpendicular outward of said generally planar cross-slot antenna.

14. An antenna assembly according to claim 12 and wherein said additional coaxial signal feed connector comprises a monopole antenna.

15. An antenna assembly according to claim 13 and wherein said additional coaxial signal feed connector comprises a monopole antenna.

16. An antenna assembly according to claim 12 and wherein said antenna comprises a polarization diversity antenna.

17. An antenna assembly according to claim 13 and wherein said antenna comprises a polarization diversity antenna.

18. An antenna assembly according to claim 14 and wherein said antenna comprises a polarization diversity antenna.

19. An antenna assembly according to claim 15 and wherein said antenna comprises a polarization diversity antenna.

* * * * *